United States Patent [19]

Ishii

[11] Patent Number: 4,937,932

[45] Date of Patent: Jul. 3, 1990

[54] MEMBRANE PANEL SWITCH

[75] Inventor: Toshihiro Ishii, Fukuyama, Japan

[73] Assignee: Ishii Hyoki Co., Ltd., Japan

[21] Appl. No.: 423,329

[22] Filed: Oct. 18, 1989

Related U.S. Application Data

[62] Division of Ser. No. 153,675, Feb. 8, 1988, Pat. No. 4,892,988.

[30] Foreign Application Priority Data

Apr. 10, 1987 [JP] Japan ..... 62-89311

[51] Int. Cl.[5] ..... H01H 11/00

[52] U.S. Cl. ..... 29/622

[58] Field of Search ..... 29/622; 200/512, 516, 200/517

[56] References Cited

U.S. PATENT DOCUMENTS

| | | | |
|---|---|---|---|
| 4,059,737 | 11/1977 | Gergaud | 200/516 |
| 4,164,634 | 8/1979 | Gilano | 200/517 |
| 4,258,096 | 3/1981 | La Marche | 200/512 |
| 4,263,485 | 4/1981 | Corwin | 200/512 |
| 4,439,646 | 3/1984 | Bouvrande | 200/516 |
| 4,439,647 | 3/1984 | Calandrello et al. | 200/512 |

FOREIGN PATENT DOCUMENTS 2902357 7/1980 Fed. Rep. of Germany .

*Primary Examiner*—P. W. Echols

*Attorney, Agent, or Firm*—William A. Drucker

[57] ABSTRACT

A membrane panel switch is formed by cutting holes in a sheet of extruded foam-molded polypropylene having a thickness greater than 2 mm. The sheet is placed on a printed circuit board with a pair of contact elements located in each of the holes. Clicking plates with extensions projecting from them are placed in the holes in contact with one contact element and spaced from the other. A press plate with a spherical upper surface and holes in the lower surface is placed in each of the sheet holes with the clicking plate extensions projecting into the press plate's lower surface holes. An insulating layer is coupled to the to cover the sheet holes and components therein.

1 Claim, 5 Drawing Sheets

MEMBRANE PANEL SWITCH

This is a division, of application Ser. No. 07/153,675, filed Feb. 8, 1988 now U.S. Pat. No. 4,892,988.

BACKGROUND OF THE INVENTION

The present invention relates to a membrane panel switch which is usually used as a switch in the operation section of a control panel.

Membrane panel switches as shown in FIG. 5 are conventional. The production of such conventional membrane panel switches is that, after a spacer (22) consisting of a hard type synthetic resin of a certain fixed thickness, etc., is installed on a substrate (21) in which a contact point "P" is formed, a switch structure (24) is inserted in a cut out hole (23) of said spacer (22) and a shielding sheet (25) is provided on said spacer (22).

OBJECT OF THE INVENTION

In conventional membrane panel switches of the type mentioned above, it has been costly to produce a spacer (22) of a desired thickness and shape.

One of the objects of the present invention is to easily provide such a spacer of a desired thickness and shape by using an extruded foam molding polypropylene as the material of said spacer in order to solve the problems mentioned above.

Another object of the present invention is to produce switch plates and their cut out holes very inexpensively because said materials (e.g., extruded foam molding polypropylene) can be easily cut by a Thompson blade to any desired dimensions and shapes without use of expensive metal dies, etc.

DESCRIPTION OF THE PREFERRED EMBODIMENTS

Figure 1B:
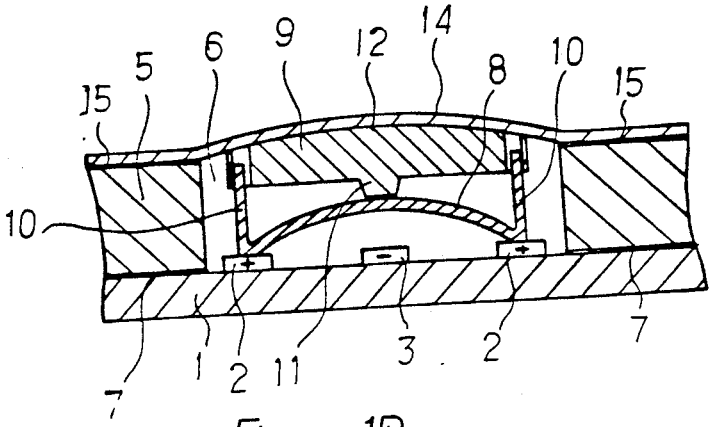
FIG. 1 shows a membrane panel switch in accordance with the present invention, (a) thereof indicating a sectional view when the spacer is thick, (b) thereof indicating another sectional view when the spacer is thin.
Figure 1A:
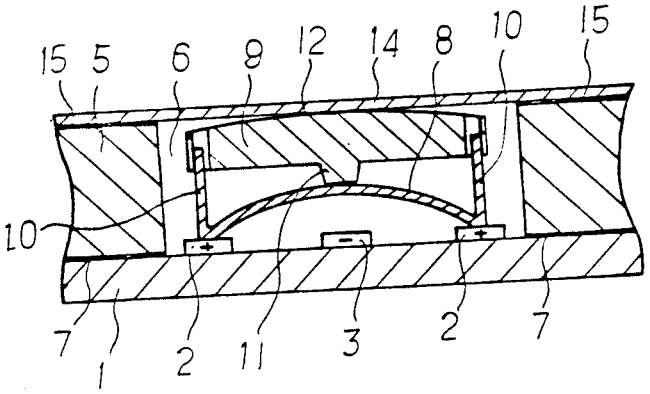
Figure 2:
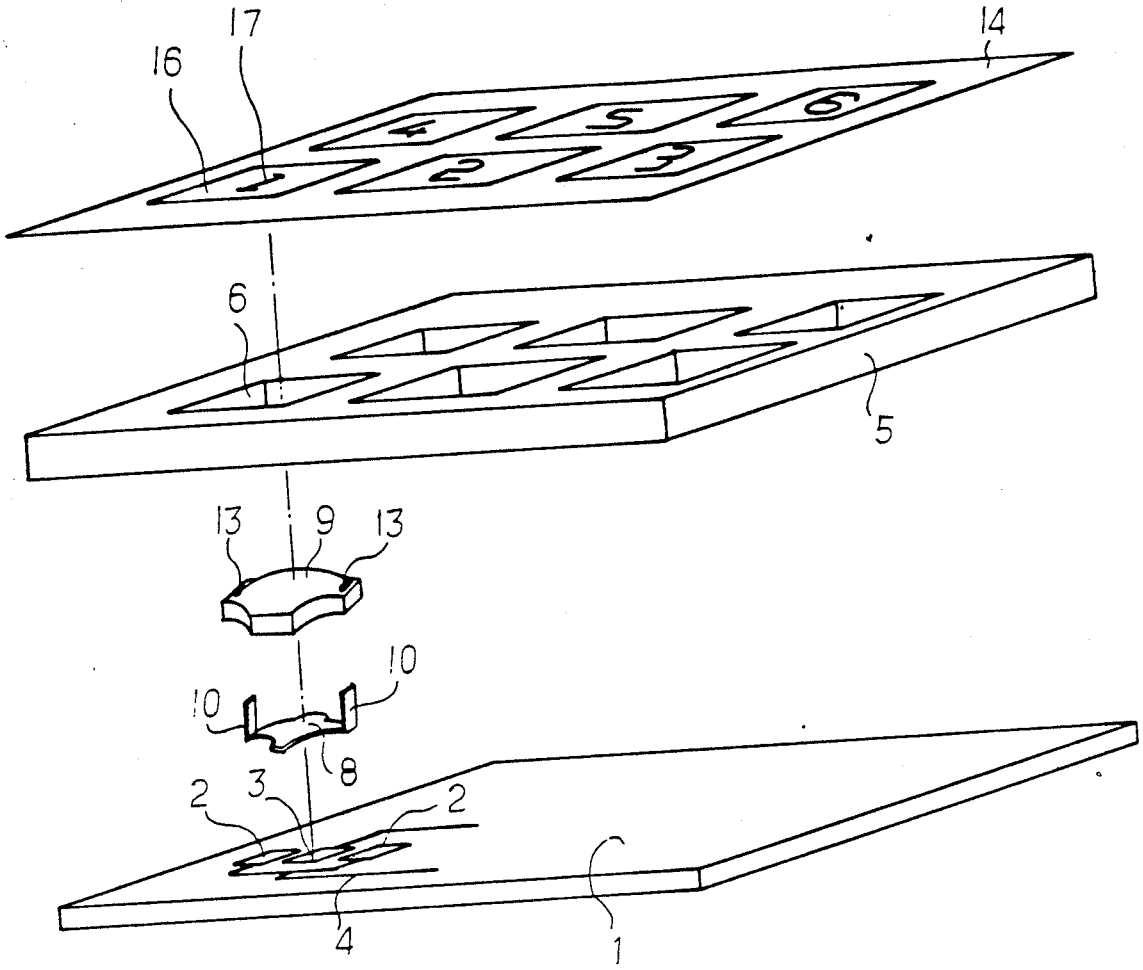
FIG. 2 is a perspective view showing the construction of said membrane panel switch.
Figure 3A:
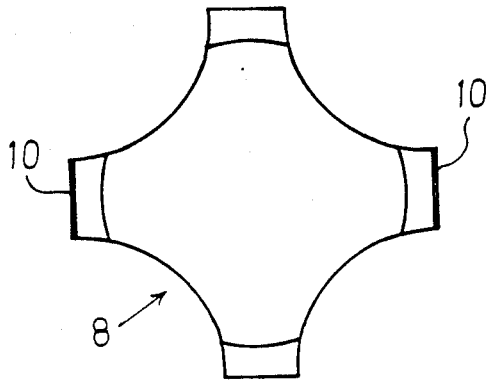
FIG. 3 shows a clicking plate, wherein (a) thereof is a plan view, (b) thereof is a central sectional view observed from the front and (c) thereof is another central sectional view observed from the side.
Figure 3C:
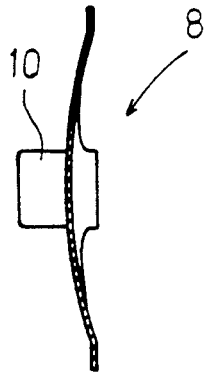
Figure 3B:
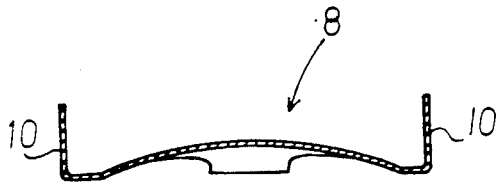

Explaining the present invention in accordance with FIG. 1(*a*), an extruded foam-molded polypropylene sheet material whose thickness is 2 mm or more is cut off or punched out by a Thompson blade in order to provide cut out holes (6) for a switch having a certain fixed size to create a spacer (5). This spacer is installed on a printed circuit board (1) on which contact points (2) and (3) are provided, and, at the same time, in said cut out hole (6), a clicking plate (8) which is to short circuit said contact points (2) and (3) and a press plate (9) having a spherically projected portion (12) at the upper surface thereof are inserted one after another by utilizing the thickness of said spacer (5). Next, a shielding sheet (14) is attached and provided on the upper surface of said spacer (5) to cover said cut out hole (6).

As extruded foam-molded polypropylene is used as the material in the present invention, it is possible to very easily produce a spacer of a desired thickness under a mass production system, and, even though the thickness is more than 2 mm, it is possible to easily punch out various kinds of cut out holes (6) for switches and the outside shape of a spacer by means of a Thompson blade. Therefore, said spacer (5) can be produced at a much lower cost than conventional methods, (i.e., using molding metal dies).

If the thickness of material is 5 mm or so, an error of about ±10% of the thickness may occur on the surface of the plate material. According to the present invention, the problem of difficulty of pressing down the press plate can be avoided because of a spherically projected portion (12) where the thickness of the spacer is so large that the press plate (9) is sunk in the through hole for the switch.

DESCRIPTION OF THE PREFERRED EMBODIMENT

The detailed example of an embodiment of the present invention on the basis of FIGS. 1 to 4 is explained hereinafter.

A conventional type printed circuit board substrate (1) consists of a positive contact point (2), a negative contact point (3) and a circuit (4). A spacer whose thickness is more than 2 mm is indicated at (5). When working this spacer, an extruded foam-molded polypropylene plate is punched out by a Thompson blade to secure the outside profile of the spacer itself and cut out holes (6) for switches at the same time.

This spacer is installed on said printed circuit board substrate (1) and is so set that said cut out holes (6) for switches can include said contact points (2) and (3) of said printed circuit board substrate (1). In addition, in this embodiment, said spacer (5) is adhered and fixed to said printed circuit board substrate (1) with double-side adhesive tape (7).

Figure 4A:
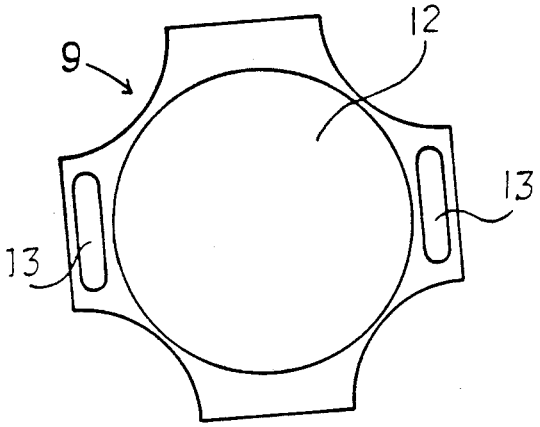
FIG. 4 shows a press plate, (a) thereof is the plan view, (b) thereof is the front elevational view and (c) thereof is a side view.
Figure 4C:
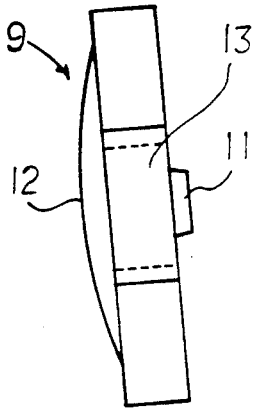
Figure 4B:
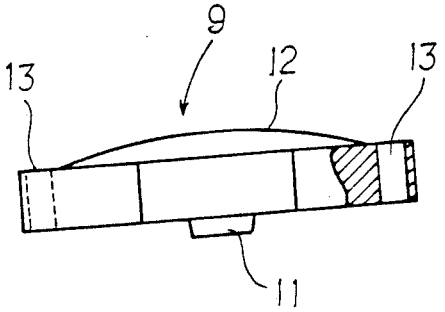
Figure 5:
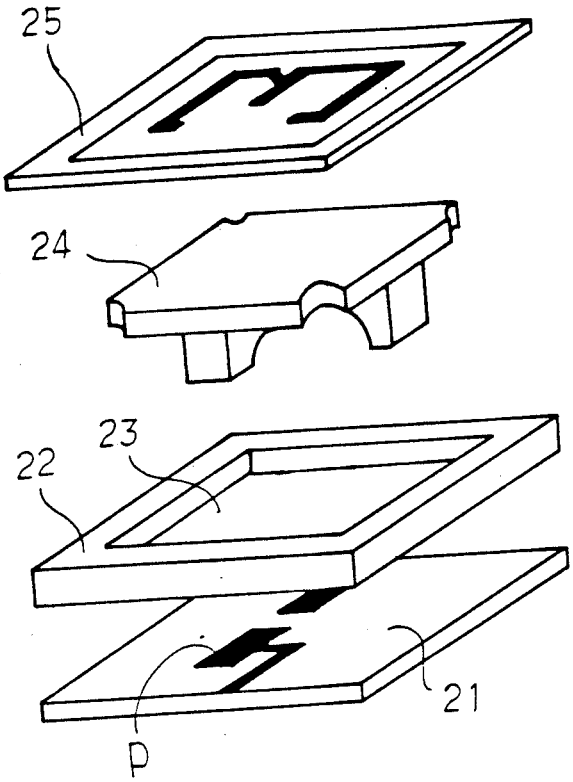
Figure 5 PRIOR ART
FIG. 5 is a sectional view showing an example of a conventional membrane panel switch.

Next, a clicking plate (8) and a press plate (9) are inserted one after another in said cut out holes (6) for the switch from the upper opening thereof so that they can be located as required. Said clicking plate (8) is so formed that its shape, observed in the plane, can be roughly like a cross (+) and it shape observed in the section can be upwardly projected, said clicking plate (8) is flexibly deformed to be flat when being subjected to a force of several hundred grams and can be repeatedly restored to its original shape when said force is removed. The clicking plate (8) is composed of electrically conductive material so as to short circuit said respective contact points 2 and 3 when it becomes flat. Furthermore, said clicking plate is supplied with projections (10) and (10) at both the sides thereof. As shown in FIG. 4(*a*) to (*c*), said press plate (9) is formed in the shape observed in the plane view roughly with the same size as that of said cut out hole (6) for the switch and is provided with a projection (11) which is projected downwards at the middle part thereof and is also provided with a spherically projected portion (12). In addition, said press plate (9) is also provided, at both the sides thereof, with through holes (13) in which said projections (10) are inserted and guided.

Finally, a shielding sheet (14) is provided on the upper surface of said space (5) in order to cover the upper opening of cut out holes (6) for the switch. In this embodiment, said shielding sheet (14) is adhered and fixed to said spacer (5) by means of double-side adhesive tape (15). In addition, said shielding sheet is bendable and flexible, on which frame lines (16) showing the position of respective switches and numbers showing respective switch numbers are marked.

In this case, even though unpredictable errors (±) in the thickness of said spacer (5) should occur at either of said cut out holes (6) for switches, there is no problem in the pressing operations of said press plate (9) under such conditions as shown in FIG. 1(*a*) (in the case of negative error) or in FIG. 1*b*) (in the case of positive error) since a spherically projected portion (12) is secured at every press plate (9).

Operation of respective switches is such that one may press down the upper surface of said shielding sheet (14) with his finger. In the embodiment disclosed by the present invention, if a pressing force is applied to a part other than the upper center area of a switch portion, said pressing force can be completely transmitted to said press plate (9), thereby causing said press plate (9) to go down along with guide means of the peripheral wall of said cut out holes (6) for the switches and causing the central part of said clicking plate (8) to be pressed by said projection (11) thereof. Therefore, said clicking plate (8) can be elastically deformed to short circuit said contact points (2) and (3), thereby causing the switch to be turned on.

In operation of the switches, said spherically projected portion (12) of said press plate (9) can suitably accomplish the downward transmission of pressing force by a finger. At the same time, the projections (10) of the clicking plate (8) are inserted and guided in through holes (13) of the pressing plate (9) so that the clicking plate can never slide sideways, thereby allowing the switch to operate accurately.

Next, as the finger pressing said press plate (9) is released from the upper surface of said shielding sheet (14), the pressing force operating on said clicking plate (8) is removed, thereby causing said clicking plate to return to its original state. At the same time, said pressing plate (9) returns to its original state also, thereby causing the switch to be turned off.

As described above, as extruded foam-molded polypropylene is utilized as the material of said spacer (5) according to the present invention, it becomes possible to produce the spacer (5) of a desired thickness much simpler and inexpensively than any conventional methods. Besides, as a spherically projected portion (12) is formed at said pressing plate (9) in the present invention, it will not be difficult to operate switches by said press plate (9), even though more or less difference (or error) is produced in the thickness of said spacer (5). Furthermore, as the press plate (9) has the through holes (13) in which the projections (10) of the clicking plate (8) are inserted, the clicking plate can never slide sideways during operation of the switches. As a result, the present invention permits membrane panel switches of various thicknesses, shapes and sizes to be produced inexpensively without spoiling any accurate functions of said switches.

Since extruded foam-molded polypropylene is superior in heat resistance property to other materials, there is no problem if a thermal lamp (whose temperature usually reaches 50 degrees C. to 60 degrees C.) is installed.

I claim:

1. A method of making a membrane panel switch, comprising the steps of:

(a) providing a sheet of extruded foam-molded polypropylene having a thickness of greater than 2 mm;

(b) forming apertures for switches in said sheet by cutting said sheet with a blade;

(c) placing said sheet on a printed circuit board having a pair of contact elements disposed within said apertures;

(d) placing a clicking plate in at least some of said apertures in contact with one of said contact elements and spaced from the other of said contact elements, said clicking plates each having at least projection with a free end;

(e) placing a press plate having a spherical upper surface, a lower surface and at least one hole in the lower surface in each said aperture containing a clicking plate, said lower surface contacting said clicking plate and at least one free end extending into at least one lower surface hole; and (f) coupling an insulating layer to said sheet extending over said aperture and over said spherical upper surface.

* * * * *